United States Patent [19]

O'Brien

[11] Patent Number: 4,620,173

[45] Date of Patent: Oct. 28, 1986

[54] LATCHING MAGNETIC ACTUATOR

[75] Inventor: Robert B. O'Brien, Pittsford, N.Y.

[73] Assignee: Robert K. O'Brien, Rochester, N.Y.

[21] Appl. No.: 738,299

[22] Filed: May 28, 1985

[51] Int. Cl.[4] ..... H01H 9/00

[52] U.S. Cl. ..... 335/205; 335/169; 335/170; 335/206; 335/207; 335/233; 335/253

[58] Field of Search ..... 335/170, 169, 184, 136, 335/207, 267, 232, 233, 253, 205, 206

[56] References Cited

U.S. PATENT DOCUMENTS

| | | | |
|---|---|---|---|
| 2,967,545 | 1/1961 | Schmidt | 335/253 |
| 3,001,049 | 9/1961 | Didier | 335/136 |
| 3,387,185 | 6/1968 | Pearse | 361/160 |
| 3,401,362 | 9/1968 | Spiroch et al. | 335/17 |
| 3,491,317 | 1/1970 | Harris | 335/205 |
| 4,004,258 | 1/1977 | Arnold | 335/17 |

OTHER PUBLICATIONS

IBM Technical Disclosure Bull., *Latch Relay,* W. F. Beausoleil et al, vol. 11, No. 11, 4/69, 1467–1468.

*Primary Examiner*—E. A. Goldberg
*Assistant Examiner*—Lincoln Donovan
*Attorney, Agent, or Firm*—Hoffman Stone

[57] ABSTRACT

A magnetically driven and latched actuator includes an armature, at least a part of which is of a ferromagnetic material, mounted for reciprocating travel between two spaced apart limit positions. An electrical coil is operative upon the ferromagnetic material to drive the armature alternately back and forth between the limit positions, and a pair of auxiliary ferromagnetic bodies are fixed, each adjacent to a respective one of the limit positions. The auxiliary bodies and the ferromagnetic portion of the armature are mutually magnetically attracted to each other so that the armature becomes magnetically latched at the limit position to which it is last driven by the coil.

14 Claims, 3 Drawing Figures

LATCHING MAGNETIC ACTUATOR

This invention relates to a novel, magnetically operated actuator of the kind having an armature that is movable along a predetermined path between two, spaced apart, operative positions.

In the actuator of the invention permanent magnet means are provided for magnetically latching the armature in each of its two operative positions, and the armature is driven between the two positions by momentary energization of an electrical coil.

The invention arose in connection with attempts to devise a system for controlling so-called reed switches, of the kind described, for example, in U.S. Pat. No. 3,387,185, issued June 4, 1968 to J. N. Pearse. It is believed, however, that actuators according to the invention will be found useful in many other systems where it is desired to provide motion between two spaced apart positions and latching at each position without the continuous application of energy or the use of separate latching devices that require an unlatching motion apart from movement of the actuating element itself to disengage them.

BRIEF DESCRIPTION

The invention contemplates the use of permanent magnets for latching the armature at each of its limit positions, and an electrical coil for driving the armature in reciprocation between the limit positions, overcoming the latching force of the permanent magnets at the start of each transverse of the armature between the two positions. Two somewhat different embodiments are described.

In the first case, two spaced apart, coaxial, energizing coils are used, one for each direction of travel of the armature. The armature is carried on, or may simply include, a shaft having two soft magnets fixed to it and spaced from each other a distance different from the spacing on centers of the coils by the amount of travel desired for the armature. The portions of the shaft that carry the magnets extend respectively into the coils so that one of the magnets lies within each coil. Energization of one of the coils draws the magnet within it to the center of the coil, and alternate energization of the two coils reciprocates the shaft through the desired travel. Permanent magnets, called latching magnets, are fixed, one within each of the coils, for engaging the magnets when they are drawn to the centers of the coils and retaining them there when the coils are deenergized.

When the first coil is energized, it draws the magnet within it to its center, where the magnet is engaged and held by the latching magnet therein until the opposite coil is energized to overcome the holding force of the latching magnet within the first coil and draw the shaft through its travel to the position where the opposite magnet is at the center of the second, opposite, coil and engaged by the latching magnet there.

In the embodiments described herein, the armatures carry permanent magnets for operating reed switches. However, it is also contemplated that the armatures may be arranged to provide mechanical motion of any desired sort. For this end, the magnet that operates the reed switches may be omitted, and the shaft extended beyond the remote end of one or both of the coils for engagement with any object to be moved.

In the second embodiment, only a single coil is theoretically needed, and the armature is itself a permanent magnet polarized in the direction of its travel. It is either fixed to or slidable on a shaft which extends between the coils. If it is fixed to the shaft, the shaft becomes a part of the armature, otherwise, the magnet alone constitutes the entire armature. Pole pieces, or keepers, of a soft magnetic material are positioned to be engaged by the permanent magnet at each end of its travel and to latch the magnet by virtue of the magnetic attraction developed by it, itself, toward the keeper. The coil is energized in one polarity to drive the magnet in one direction, toward the first one of the keepers, and is energized in the opposite polarity for the reverse drive.

DETAILED DESCRIPTION

Representative embodiments of the invention will now be described in conjunction with the drawing, wherein.

Figure 1:
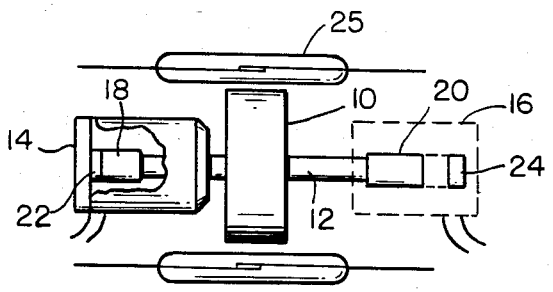
FIG. 1 is a side elevational view, partly in section, of an actuator according to a first embodiment of the invention.

Referring first to FIG. 1, the actuator according to the first embodiment of the invention includes a base support, not shown, which may be arranged as desired according to the designer's choice. An armature 10, in the example shown, includes a disc-shaped permanent magnet and an axially movable shaft 12 fixed to the magnet. The opposite ends of the shaft 12 extend respectively into two electrical coils 14 and 16, which are fixed in coaxial alignment with each other and the shaft. The shaft carries two soft ferromagnetic pieces 18 and 20, one at each end of the shaft. The soft magnets 18 and 20 are spaced apart from each other a distance less than the distance, on centers, between the two coils 14 and 16 by an amount equal to the travel it is desired to impart to the armature. Permanent magnets 22 and 24 are fixed within the respective coils 14 and 16 for engaging the respective soft magnets 18 and 20 when they reach the travel limits and magnetically latching them there despite deenergization of the coils.

The element 10 is driven to the left by momentary energization of the left coil 14, and is driven to the right by momentary energization of the right coil 16. It is latched magnetically in each position by the respective permanent latching magnets 22 and 24, which engage the soft magnets 18 and 20, respectively.

It is, of course, feasible to use a converse arrangement in which energization of the left coil 14 drives the element to the right, and energization of the right coil returns the element 10 to the left. In this converse arrangement the spacing between the soft magnets 18 and 20 is greater by the amount of travel than the on-center spacing between the coils.

As shown, a plurality of reed switches 25 are arrayed around the element 10 for actuation by it, being switched to one condition when the element 10 is at the left, and to an opposite condition when the element is at the right.

In practice, it has been found that in some applications reasonably reliable operation of the reed switches may be achieved with as little as a one-tenth inch travel of the element 10. However, any desired extent of motion may be achieved by suitable designer's choice of the dimensions of the various parts, including the coils, the soft magnets, and the latching magnets. Also, as hereinabove stated, the armature 10 need not include the magnet 10 as shown, but may be any type of device according to the use for which the actuator is intended.

Figure 2:
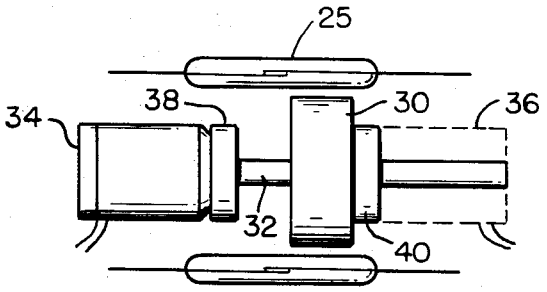
FIG. 2 is a side elevational view of an actuator according to a second, and presently preferred, embodiment of the invention.

An actuator according to a second, and presently preferred embodiment of the invention is shown in FIG. 2. It includes a permanent magnet 30 slidable on, or fixed to, a shaft, or rail 32 for travel between left and right limit positions. Electrical coils 34 and 36 are fixed at the respective ends of the shaft 32 for receiving end portions of the shaft and supporting it. Pole pieces 38 and 40 of soft magnetic material are fixed at the inwardly facing ends of the respective coils 34 and 36 and serve as abutment stops and latching anchors for the magnet 30.

The shaft 32 is preferably of a non-magnetic material. It may be fixed either to the coils 34 and 36 or to the magnet 30, in which latter case it is axially movable through the pole pieces and in the coils and moves with the magnet.

The magnet 30 is of a hard magnetic material, that is, a material having high coercivity such as, for example Alnico 8, a hard ceramic ferrite, or one of the recently developed samarium alloys. It is magnetized in the axial direction, one pole being on its left face and the opposite pole on its right face.

In operation, only one of the coils need be energized to drive the magnet 30 from one of its operative positions to the other, although both coils may be energized simultaneously if maximum driving force is desired. The magnet 30 rests in latched condition either against the left pole piece 38 or the right pole piece 40. To drive it from its left hand position the left coil 34 is energized in a polarity to repel the magnet 30, driving it into engagement with the right pole piece 40 where it is magnetically latched by its own magnetic attraction to the pole piece.

In theory, only one coil is necessary in this embodiment, being energized in one polarity to repel the magnet 30 and in the opposite polarity to attract it. However, because of the spacing of the magnet 30 from the single coil when the magnet is away from the coil, a relatively strong energization is required to overcome the magnetic force holding the magnet 30 to the distant pole piece and draw the magnet to the coil. It is preferred, therefore to use the two coils, as shown, and sometimes to energize both coils simultaneously, in one polarization to drive the magnet 30 to the left, and in the opposite polarization to drive it to the right.

The second embodiment, the one shown in FIG. 2, is the presently preferred embodiment of the invention because it is of relatively simpler and somewhat less expensive construction than the first embodiment, and also because it is apt to be more reliable. The operative magnet 30 is generally much stronger than the latching magnets 22 and 24 of the first embodiment so that the latching force can be relatively stronger in the second than in the first embodiment. Also, the pole piece 38 and 40 can be made considerably larger than the soft magnets 18 and 20 and the latching magnets 22 and 24, contributing further to the latching force.

The matter of latching force can be important in many applications, especially where equipment may be subjected to ambient forces such as vibration or physical shock. When subjected to shock certain ones of the reed switches may momentarily change condition, but if the operative magnet remains in its pre-shock, latched position, the reed switches will rapidly return to their pre-shock conditions.

The actuator according to the first embodiment operates essentially as a solenoid, with the respective soft magnets being drawn to the centers of the magnetic fields produced by the coils. On the other hand, the actuator according to the second embodiment operates on a direct magnetic force, primarily the repulsion of the operative magnet by the latching pole piece due to reversal of the magnetic polarity of the pole piece caused by energization of the coil.

Figure 3:
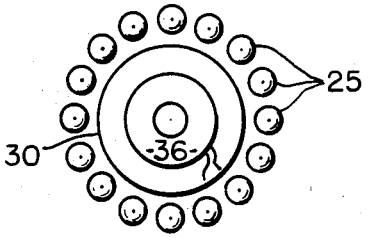
FIG. 3 is an end elevational view of an actuator according to the invention illustrating a typical array of reed switches around the actuator.

FIG. 3 is an end elevational view showing how the reed switches 25 may be arrayed around the magnet 30 of the second embodiment or the magnet 10 of the first embodiment. Typically some sixteen reed switches are controlled simultaneously by the single magnet 10 or 30. The actual number is not definitely limited except by the field strength of the magnet. As many as thirty-six reed switches have been successfully controlled in actual bench tests by a single magnet.

What is claimed is:

1. A magnetic actuator comprising an armature, at least a portion of said armature being ferromagnetic, means mounting said armature for reciprocating, rectilinear travel between two predetermined limit positions relative to a selected frame of reference, a pair of auxiliary ferromagnetic bodies, means mounting each of said auxiliary bodies in a fixed position adjacent to a respective one of said limit positions, and electrical coil means operative upon said ferromagnetic portion of the armature to drive the armature alternately in reciprocation between said limit positions, one of said portion of said armature and said auxiliary bodies being of a hard magnetic material and permanently magnetized, said auxiliary bodies and said ferromagnetic portion of said armature being mutually attracted by magnetic forces whereby said armature is magnetically latched at the limit position to which it is last driven by the coil means.

2. A magnetic actuator comprising an electrical coil for producing a magnetic field when it is energized, a permanent magnet, means mounting said magnet adjacent to one end of said coil, said magnet being polarized in the direction of the central, winding axis of said coil, a pair of soft ferromagnetic keepers adjacent to said one end of said coil and fixed relative thereto, said keepers being positioned respectively on opposite sides of said magnet and being spaced apart a distance greater than the length of said magnet, said magnet being movable in the direction of its polarization between said keepers, whereby when said coil is energized in one polarization it drives the magnet toward one of said keepers and into abutment thereagainst, and when the coil is energized in the opposite polarization it draws the magnet away from said one keeper and into abutting engagement with the other one of said keepers.

3. A magnetic actuator according to claim 2 including also a second electrical coil coaxially aligned with and spaced from said first named coil, and wherein said keepers are fixed at the mutually facing ends of said coils.

4. A magnetic actuator according to claim 2 wherein said means mounting said magnet is a shaft fixed to said coil and coaxially aligned with the winding axis of said coil, and said magnet is slidable on said shaft.

5. A magnetic actuator according to claim 2 wherein said means mounting said magnet is a shaft having an end portion slidable within said coil and end portions slidable through said keepers, and said magnet is fixed to said shaft.

6. A magnetic actuator according to claim 2 including further a plurality of electrical reed switches mounted in predetermined positions adjacent to said permanent magnet for actuation thereby in response to changes in the position of said magnet.

7. A magnetic actuator comprising a base support, guide means extending between two spaced apart, fixed positions on said support, first and second electrical coils fixed to said support at said fixed positions respectively, a permanent magnet mounted on said guide means for reciprocating travel between between said positions, said magnet being polarized in the direction of its travel, soft ferromagnetic pole pieces fixed adjacent to said coils at the ends thereof facing said guide means for alternately abuttingly engaging said permanent magnet when it arrives at the respective opposite ends of its travel, whereby when the one of the coils closer to the permanent magnet than the other coil is energized in a polarity to repel the permanent magnet the magnet is driven from one end of its travel to the other end and becomes latched thereat by its own magnetic attraction to the pole piece there.

8. A magnetic actuator according to claim 7 wherein said pole pieces are mounted directly on said coils, said pole pieces are centrally apertured, and said shaft extends through the central apertures of said pole pieces.

9. A magnetic actuator according to claim 7 arranged for actuating a plurality of reed switches and including a plurality of reed switches arranged in a circular array around said permanent magnet to be driven into one condition when said shaft is at its first position and into the opposite condition when said shaft is at its second position.

10. A magnetic actuator comprising a base support, a shaft, means mounting said shaft for reciprocating longitudinal travel between first and second positions relative to said support, a ferromagnetic body fixed to said shaft, an electrical coil fixed on said support and positioned to produce when it is energized a magnetic field that acts upon said ferromagnetic body to drive said shaft from its first to its second position, and a second, auxiliary ferromagnetic body fixed relative to said coil for abuttingly engaging the first said ferromagnetic body when said shaft arrives at its second position and magnetically retaining the shaft thereat by magnetic attraction between the first said ferromagnetic body and said auxiliary ferromagnetic body after the coil is deenergized, one of said first and said second ferromagnetic bodies being of a hard magnetic material and permanently magnetized.

11. A magnetic actuator according to claim 10 wherein the first said ferromagnetic body is of a soft magnetic material, and said auxiliary ferromagnetic body is of a hard magnetic material and permanently magnetized.

12. A magnetic actuator according to claim 10 wherein said shaft extends into said coil, the first said ferromagnetic body is of a soft magnetic material and is fixed on said shaft within said coil so that when said coil is energized it draws the first said ferromagnetic body to a position midway along the length of the coil.

13. A magnetic actuator according to claim 10 wherein first and second ferromagnetic bodies are fixed to said shaft spaced apart lengthwise thereof, said coil is positioned to act only on said first body, said actuator further including a second electrical coil positioned to act only on said second ferromagnetic body, said coils being coaxially aligned with each other and with said shaft, and the lengthwise centers of said coils being spaced apart a distance different from the spacing between said first and second ferromagnetic bodies by an amount approximately equal to the design travel of the shaft.

14. A magnetic actuator according to claim 10 including also a plurality of reed switches, and magnetic means for actuating said reed switches, said magnetic means including a permanent magnet fixed to said shaft at a position therealong spaced from said coils, said reed switches being arrayed around said permanent magnet.

* * * * *